United States Patent [19]

Rabe

[11] 4,042,316

[45] Aug. 16, 1977

[54] GAS LIGHTER BURNER

[75] Inventor: Peter Rabe, Muhlheim (Main), Germany

[73] Assignee: Rowenta-Werke, GmbH, Germany

[21] Appl. No.: 650,206

[22] Filed: Jan. 19, 1976

[30] Foreign Application Priority Data

Jan. 21, 1975 Germany ..... 2502138

[51] Int. Cl.[2] ..... F23Q 2/16

[52] U.S. Cl. ..... 431/344; 236/93 R

[58] Field of Search ..... 431/277, 344; 236/93 R, 236/101 R

[56] References Cited

U.S. PATENT DOCUMENTS

| | | | |
|---|---|---|---|
| 2,620,643 | 12/1952 | Nissen | 236/93 R X |
| 3,174,310 | 3/1965 | Genoud | 431/344 X |
| 3,590,591 | 7/1971 | Genoud | 431/344 X |
| 3,663,152 | 5/1972 | Yoshida | 431/344 |
| 3,770,367 | 11/1973 | Court | 431/344 X |
| 3,895,905 | 7/1975 | Nissen | 431/277 X |
| 3,966,392 | 6/1976 | Lockwood | 431/344 |

*Primary Examiner*—Alan Cohan
*Assistant Examiner*—Gerald A. Michalsky
*Attorney, Agent, or Firm*—George R. Clark; Neil M. Rose; Clifford A. Dean

[57] ABSTRACT

A gas lighter burner having a porous throttle disc for controlling the flow of gas therethrough and a mechanism which interacts with the throttle disc as a result of changes in its axial length due to changes in temperature whereby the throttle disc maintains a desired gas flow despite such variations in temperature.

2 Claims, 3 Drawing Figures

Fig. 2
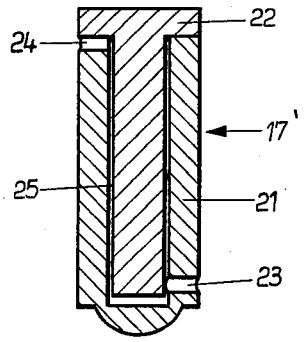
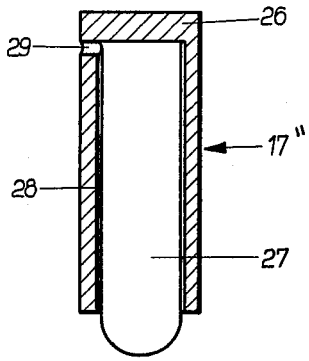
Fig. 3

GAS LIGHTER BURNER

BACKGROUND OF THE INVENTION

1. Field of the Invention

The present invention relates to a gas lighter burner having a porous throttle disc and a mechanism which exploits the temperature-related alteration in length of said mechanism for the maintenance by said throttle disc of a constant gas flow in spite of changes in temperature.

2. Description of the Prior Art

In the field of gas fueled lighters, there exists a problem with respect to varying flame height which results from pressure variations involved with the heating up of the fuel gas during use. This problem is discussed in connection with a prior art gas lighter burner disclosed in U.S. Pat. No. 2,620,643 to Nissen, dated Dec. 9, 1952. In the Nissen patent, a gas flow regulator of plastic in the shape of an upright cylinder is situated between a brass valve seating device and a connection piece of porous, sintered metal or porous china. According to this patent, the regulation of the quantity of gas theoretically occurs by means of the greater or lesser distance between the upper end surface of the cylinder and the smooth lower surface of the valve seating device. It should be understood that the temperature compensating regulation occurs between the valve seating device of brass and the porous sintered or ceramic block piece.

There is a considerable disadvantage in this prior art arrangement in that only vaporous gas can be regulated but not the liquid within the lighter. It is stated in the Nissen patent that if suitable dimensions are selected, a flame height can be achieved which is not dependent on temperature.

Mathematically expressed, the distance between the gas flow regulator and the valve seating device varies on the basis of an elongation coefficient of brass and plastic by 0.0054 mm at a change in temperature of 10° C. For a flame 40 mm in height, assuming the customary valve seating bore of 0.3 mm diameter, a medium distance of approximately 0.004 mm is required. With this arrangement it is obvious that only in theory can the desired independence of temperature be achieved.

The prior art arrangement of Nissen, which appears workable on paper, is, however, virtually inoperative. If fine screw threads are applied to the block piece or to the thread insert piece, a pitch of 0.25 mm per turn is achieved. An alteration in the distance amounting to 0.004 mm thus requires an angle of rotation of 5.8°, which is for all practical purposes unobtainable, while the utilization of micro-screw threads in a lighter cannot be justified by virtue of the production problems and the costs involved.

SUMMARY OF THE INVENTION

The present invention is based on the necessity of creating a gas lighter burner in which both vaporous gas and liquid fuel may be regulated; in which, furthermore, the flame height remains constant in spite of changes in temperature and in which temperature compensation and flame height regulation can be realized without major problems of exactitude and costs.

These objectives are achieved by means of a pressure device, manufactured from different materials, which operates in axial association with a throttle disc and as a result of the different temperature coefficients of expansion of the materials utilized in the jointly operating parts, such as the burner casing, the throttle disc, the pressure device and the adjustment screw.

In a further design version of the present invention the individual parts making up the pressure piece are arranged to slide one into the other.

The advantages achieved with the present invention consist primarily in the fact that the difficulties caused by the extremely narrow distance between the valve seating piece and the block in the known prior art discussed herein, are overcome by a porous, elastic piece arranged in the throttle positioning location. Furthermore, the varying temperature influences which determine the height of the flame and affect the burner unit, and which also vary from lighter type to lighter type, are overcome by varying only the throttle disc thickness and the position of the throttle disc adjusting screw. The same temperature compensated fitting can be utilized with less alteration for every type of lighter.

BRIEF DESCRIPTION OF THE DRAWINGS

For a better understanding of the present invention, reference may be had to the accompanying drawings in which:

FIG. 2 is a vertical sectional view of a second embodiment of a two-piece pressure device; and FIG. 3 is a vertical sectional view of a third embodiment of a two-piece pressure device.

DESCRIPTION OF THE PREFERRED EMBODIMENTS

Figure 1:
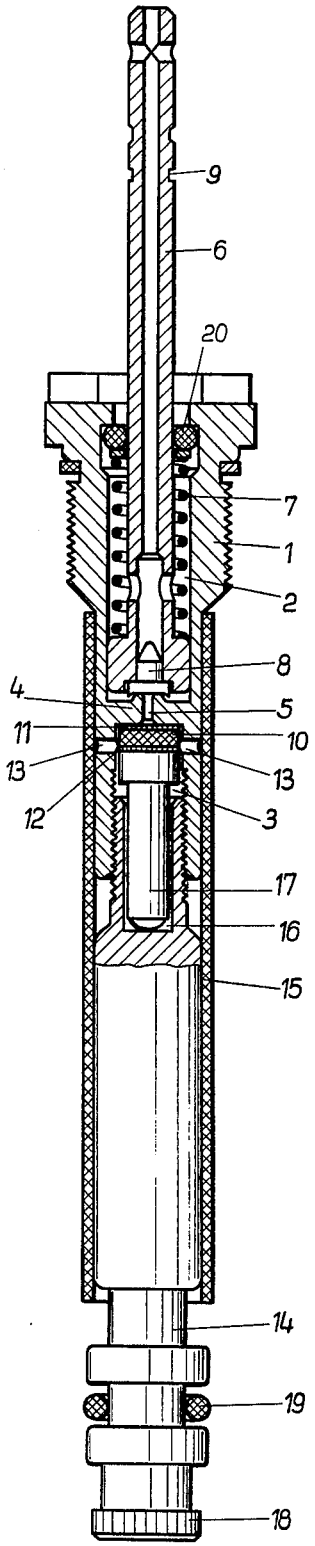
FIG. 1 is a vertical sectional view of a gas lighter burner embodying the present invention and having a one-piece pressure device.

The gas lighter burner is shown in FIG. 1 in a closed position and consists as an example of a burner casing 1, e.g. made of brass with two casing bores 2 and 3 co-axially placed in relation to one another. These two casing bores 2 and 3 are separated by a partition 4. A burner valve bore 5 is positioned in this partition 4. A burner pipe 6 is situated in the casing bore 2, slidably movable against the force of a locking-spring 7, fitted at its lower end with a burner valve gasket 8 for the opening and closing of the burner valve bore 5. The valve bore 5 is opened by the lifting of the burner pipe 6 by means of a suitable mechanism, not shown in the drawings, which is connected to the latter by a ring engaged with the annular slot or channel 9 located on the burner pipe 6. In the casing bore 3, a throttle disc 10 is located co-axial to the burner valve bore 5 and arranged between wire gauze discs 11 and 12. Liquid gas conduits 13 in the burner casing 1 connect the interior of a tank, which is not illustrated in the drawings, and the throttle disc 10. The entry of liquid gas occurs through a wick 15 slipped over the burner casing 1 and the front end of the adjustment screw 14. The adjustment screw 14, for setting the height of the flame, is screwed into a screw thread in the wall of the casing bore 3. The end of the adjustment screw facing the valve bore 5 is provided with an opening 16 which holds the plastic pressure device 17 which operates in association with the throttle disc 10. The other end of the adjustment screw 14 is fitted with a adjustment knob 18 which is grooved or knurled around the edges to facilitate use. Washers 19 and 20 are provided to seal the adjustment screw 14 in the lighter casing (not shown) and the burner pipe 6 in the burner casing 1, respectively.

A second embodiment of the device which applies pressure to the throttle disc 10, as shown in FIG. 2 as pressure device 17', consists of a plastic casing 21 with a metal core 22. The casing 21 is provided with a diagonal bore 23 on one end and on the other end a slot 24. These apertures 23 and 24 have the function of conducting liquid gas from the bottom of the core 22 through a capillary ring slot 25 to the slot 24, where it will be discharged from this space between the metal core 22 and the casing 21. It is also the case with a third embodiment of a pressure device 17'' shown in FIG. 3, which latter embodiment consists of a metal casing 26 and a plastic core 27, that liquid gas is passed through a ring slot 28 and discharged through an opening 29.

The invention is not limited to a throttle disc as described in connection with the embodiment of FIG. 1 with the adjacent positioning of a wire gauze disc as a vaporization zone and a wire gauze disc for an improved liquid gas supply, but it is contemplated that the throttle disc can also be compressed between two smooth surfaces or textured or ribbed surfaces. The portions of the pressure device may also fulfill ancillary functions, i.e. effecting the liquid gas conduction to the throttle disc 10 or acting as a protection for the throttle disc 10 against torsional stress arising from the adjustment screw 14.

The adjustment means for the temperature compensation may also be altered, by means of the application, for compensation purposes, of a metal rod and the thermal elongation of a casing made at least in part of plastic, in the vicinity of the throttle disc 10, whereby, for example, this casing may also be realized by a plastic tank.

While there has been shown and described three preferred embodiments of the present invention, it will be apparent to those skilled in the art that various changes and modifications may be made without departing from the invention in its broader aspects and it is, therefore, contemplated in the appended claims to cover all such changes and modifications that fall within the true spirit and scope of the present invention.

What is claimed as new and desired to be secured by Letters Patent of the United States is:

1. A gas lighter burner comprising an elongated burner housing having an axially extending fuel passage formed therein, a porous, compressible throttle disc seated against the entrance end of said fuel passage, the periphery of said throttle disc being exposed to a fuel supply of liquid gas under pressure, an elongated pressure device retained in said housing and having one end disposed against said throttle disc, and an adjustment screw threadedly engaged in said housing for adjusting the position of said pressure device relative to said throttle disc, the surfaces of said pressure device, burner housing and adjustment screw being exposed to said liquid gas whereby to provide good heat transmission between said surfaces and said fuel supply of liquid gas, said pressure device being at least partially formed of a different material than said housing, said adjustment screw, and said throttle disc and having a different temperature coefficient of expansion whereby a desired flow of fuel through said fuel passage is maintained despite atmospheric and vaporization temperature variations as a result of relative changes in the axial dimension of said pressure device in response to said temperature variations and the resulting pressure changes applied by said pressure device to said porous compressible throttle disc.

2. A gas lighter burner according to claim 1 wherein said pressure device is characterized by a casing of one material having a core of another material and a different temperature coefficient of expansion slidably received in a bore formed in said casing and wherein aperture means are provided in said casing permitting the passage of liquid gas axially through said bore.

* * * * *